US007585394B2

(12) United States Patent
Heger et al.

(10) Patent No.: US 7,585,394 B2
(45) Date of Patent: Sep. 8, 2009

(54) WIRE CLOTH, IN PARTICULAR PAPER MAKING WIRE CLOTH

(75) Inventors: Wolfgang Heger, Nideggen (DE); Klaus Fichter, Jüchen (DE)

(73) Assignee: Andreas Kufferath GmbH & Co. KG, Düren (DE)

( * ) Notice: Subject to any disclaimer, the term of this patent is extended or adjusted under 35 U.S.C. 154(b) by 294 days.

(21) Appl. No.: 10/587,298

(22) PCT Filed: Feb. 3, 2005

(86) PCT No.: PCT/EP2005/001070

§ 371 (c)(1),
(2), (4) Date: Jul. 26, 2006

(87) PCT Pub. No.: WO2005/106115

PCT Pub. Date: Nov. 10, 2005

(65) Prior Publication Data

US 2007/0125911 A1 Jun. 7, 2007

(30) Foreign Application Priority Data

Mar. 30, 2004 (DE) ..... 10 2004 016 640

(51) Int. Cl.
*D21F 1/10* (2006.01)
*D03D 3/04* (2006.01)

(52) U.S. Cl. ..... 162/348; 139/383 A

(58) Field of Classification Search ..... 162/116, 162/348, 358.2, 900, 902, 903, 904; 139/383 A, 139/425 A, 383 AA; 245/2
See application file for complete search history.

(56) References Cited

U.S. PATENT DOCUMENTS

| | | | | | |
|---|---|---|---|---|---|
| 4,359,069 | A * | 11/1982 | Hahn | ..... | 139/383 A |
| 5,564,475 | A * | 10/1996 | Wright | ..... | 139/383 A |
| 6,227,256 | B1 * | 5/2001 | Quigley | ..... | 139/383 A |

FOREIGN PATENT DOCUMENTS

| | | |
|---|---|---|
| EP | 0 349 779 | 1/1990 |
| EP | 0 432 413 | 6/1991 |
| EP | 0 889 160 | 1/1999 |
| WO | WO 99/06630 | 2/1999 |
| WO | WO 02/092907 | 11/2002 |

* cited by examiner

*Primary Examiner*—Eric Hug
(74) *Attorney, Agent, or Firm*—Roylance, Abrams, Berdo & Goodman, L.L.P.

(57) ABSTRACT

A wire cloth, in particular a paper making wire cloth, has at least two fabric layers (1B, 1T; 2B, 2T), including an upper fabric layer made of wires in the making direction (101, 110) and wires in the cross direction (121, 130), and a lower fabric layer made of wires in the making direction and wires in the cross direction (141, 145). Wire bridges are formed for the individual fabric layers in such a way that they extend over a predeterminable distance within a pattern repeat without being tied to other wires. The wire bridges of the upper cross direction wires extend within a pattern repeat over at least nine making direction wires and under maximum one making direction wire. The wire bridges of the lower cross direction wires extend within the pattern repeat at least under six and over two making direction wires. Between two making direction wires extending over a cross direction wire, at least one other making direction wire extends under the same cross direction wire.

13 Claims, 8 Drawing Sheets

1T

1B

2T

2B

3T

3B

WIRE CLOTH, IN PARTICULAR PAPER MAKING WIRE CLOTH

FIELD OF THE INVENTION

The present invention relates to wire cloth, in particular paper making wire cloth, having at least two fabric layers. The upper fabric layer is formed from making direction wires and from cross direction wires. The lower fabric layer is formed from making direction wires and from cross direction wires. For individual fabric layers, wire bridges are formed such that they do not have any binding to other wires over a definable path extension within a pattern repeat.

BACKGROUND OF THE INVENTION

The dewatering of the fibrous material suspension applied to the wire cloth from above by filtration acquires major importance in papermaking processes. The fibrous material suspension is a mixture of suitable fibers, fillers, auxiliary chemical agents, and water which forms most of the mixture. In the paper industry, this filtration process is often also called sheet formation, and takes place in the wet or sheet forming part of the papermaking machine.

To be able to produce a paper sheet as uniform as possible, it is necessary to increase the proportion of water to on average 99% within the fibrous material suspension immediately before sheet formation. During the sheet forming process, this proportion is reduced to roughly 80% again by filtration. The paper fibers, fillers and auxiliary agents remain as fiber mat on the papermaking wire cloth.

While in the past dewatering took place mainly by papermaking wire cloth on Fourdrinier paper machines, double screen machines are being used more and more often today, preferably gap formers. They are also characterized in that the fibrous material suspension is sprayed directly into the gap between the two papermaking screens, and is dewatered by the two screens. With this type of papermaking machine, the filtration process can be accelerated such that production rates of 2000 meters/min and more are possible today.

One special field within the papermaking industry is the production of sanitary paper, such as Kleenex® tissues, toilet paper, paper towels, or the like. The type of paper being used here is characterized mainly by especially low G.S.M. between 10 and 20 g/m$^2$ depending on the application. Graphic types of paper in comparison are between 42 and 120 g/m$^2$.

To form a uniform sheet with such a low G.S.M., dilution of the fibrous material suspension, which is higher than for other types of paper, is required. The concentration of fibrous material drops to approximately 0.3 to 0.5%. To be able to also effectively produce these types of paper, this larger amount of water must take place in as short a time as possible, that is to say, at the highest production speeds. At the same time, retention of the fibrous material should remain as high as possible, that is to say, only a small portion of the added fibers should be removed with water.

In the prior art (EP 0 069 101 A1, EP 0 116 945 A1, EP 0 794 283 A1, and DE 100 30 650 A1), composite fabrics are known as papermaking wire cloths. Such wire cloths have two, more or less independent, single-layer wire cloths connected to each other in different ways. For the most part, they maintain an open surface so that the high required dewatering performance is thus guaranteed. The known solutions are aimed in most instances at suitably joining a uniform paper side in the form of a two-strand fabric, also called a basket weave, to the most varied machine sides in a suitable manner.

Often, decreasing fibrous material retention favors high dewatering performance since the long wire bridges of the cross direction wires necessary for retention are not sufficiently available.

The joining of two single-layer fabrics into the papermaking wire cloth, in which longer wire bridges are formed by cross direction wires, is disclosed in EP 0 889 160 A1. The paper side (top) is implemented by a four-strand twill weave, and the machine side (bottom) is implemented by a four-strand basket weave. The two layers are joined by binding of a paper-side making direction wire to a machine-side cross direction wire. This type of fabric is characterized both by higher dewatering performance and by good fiber support based on the long wire bridges. In the known solution, currently unacceptable marking caused by the type of joining of the layers often occurs. The wear potential is limited, i.e., the machine side formed largely by the making direction wires is exposed directly to wear and, as a result, seam or wire cloth cracks can occur in use. The flexural stiffness in the transverse direction is limited due to the four-strand machine side and automatic seaming which is difficult to manage and which is caused by the lower making direction threads running parallel.

SUMMARY OF THE INVENTION

An object of the present invention is to provide an improved the wire cloth design, while maintaining the advantages of the prior art designs, such that especially in the field of producing sanitary paper very high dewatering performance and fiber support are provided. At the same time, the fabric should be thin, but nevertheless mechanically stable against washboard marks and distortion, and should still have good flexural stiffness values in the transverse direction and ensure the possibility of advantageous seaming for joining the ends of the wire cloth.

This object is basically achieved by a wire cloth, where the wire bridges of the upper cross direction wires extend within a pattern repeat at least over nine making direction wires and at most under one making direction wire. Because the wire bridges of the lower cross direction wires within a pattern repeat extend at least under six and over at least two making direction wires, and because between two making direction wires extending over a cross direction wire at least one other making direction wire extends under the same cross direction wire, on the upper or paper side the long wire bridges necessary for good fiber support are obtained from cross direction wires which in conjunction with the open warp ensures the required permeability for the required high dewatering performance. In addition to better fiber support, the long wire bridges act advantageously with respect to bending stability in the transverse direction of the wire cloth. The bottom or machine side, due to the double binding of the lower cross direction wires, ensures high stability with respect to diagonal distortion. Moreover, high wear resistance in the papermaking machine is achieved by the lower cross direction wires extending under at least six making direction wires.

If the wire cloth is built up preferably from plastic filaments during production or then thermofixed, the applied tension in the direction the machine runs results in that the two binding making direction wires at the binding point move toward each other. In this way, such binding making direction wires additionally enlarge the open areas of the wire cloth. Thus, on the one hand, the permeability increases and, on the other, the lower cross direction wire is more strongly bent and continues to protrude from the lower or machine side. In this way, the lower cross direction wire can be to a larger extent "ground down" in the papermaking machine. In one preferred embodiment of the wire cloth of the present invention, the top and bottom sides are formed from the same number of making direction wires, without needing to be any fixed assignment of individual making direction wires to one of the two sides. The number of cross direction wires on the top or paper side is higher than on the bottom or machine side.

The joining of the two fabric layers to each other can be effected in different ways, for example in the form of using additional binding wires made as cross direction wires or making direction wires. Another possibility of connection is integral connection using the existing wires typical of the binding, also called structure wires, such as making direction wires or cross direction wires, which can be made both as tying and also as a replacement of two adjacent wires or wire systems.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1A:
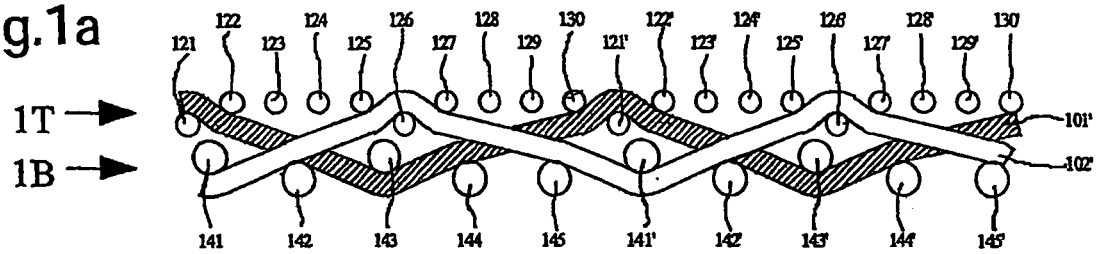
FIG. 1*a* is a side elevational view in section taken along line A-A of FIG. 1*b* and FIG. 1*c* of a papermaking wire cloth, according to a first exemplary embodiment of the present invention, illustrating the extension of the making direction wires and the layers being joined by replacement of the making direction wires.
Figure 1B:
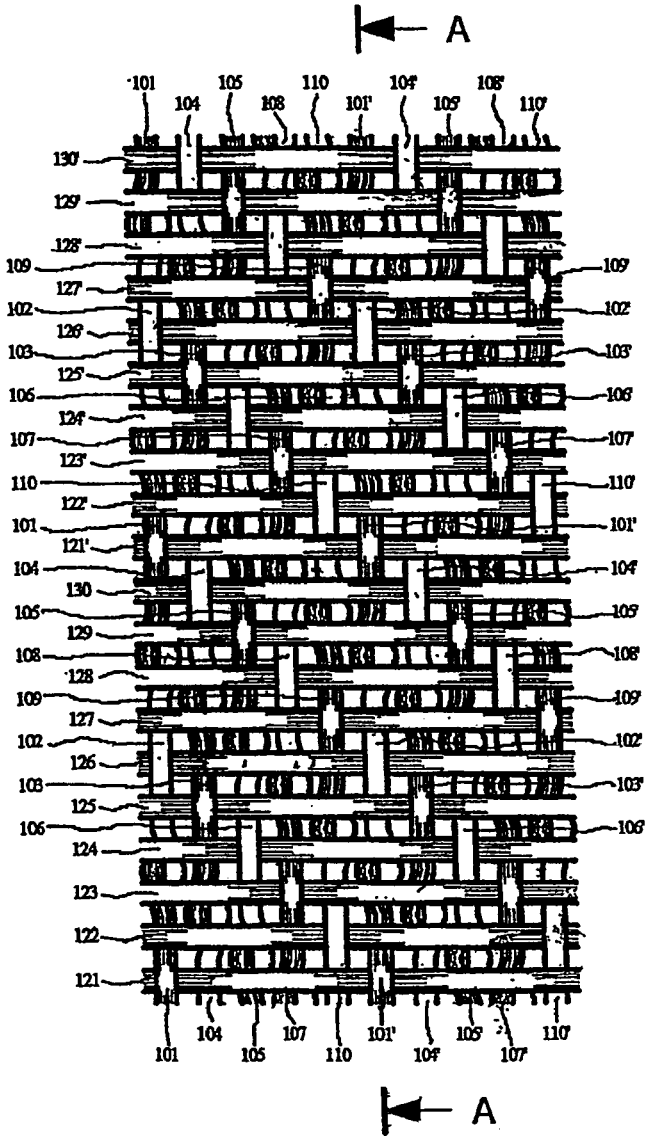
FIG. 1*b* is a top plan view of one extract of the top or paper side of the wire cloth of FIG. 1*a;*
Figure 1C:
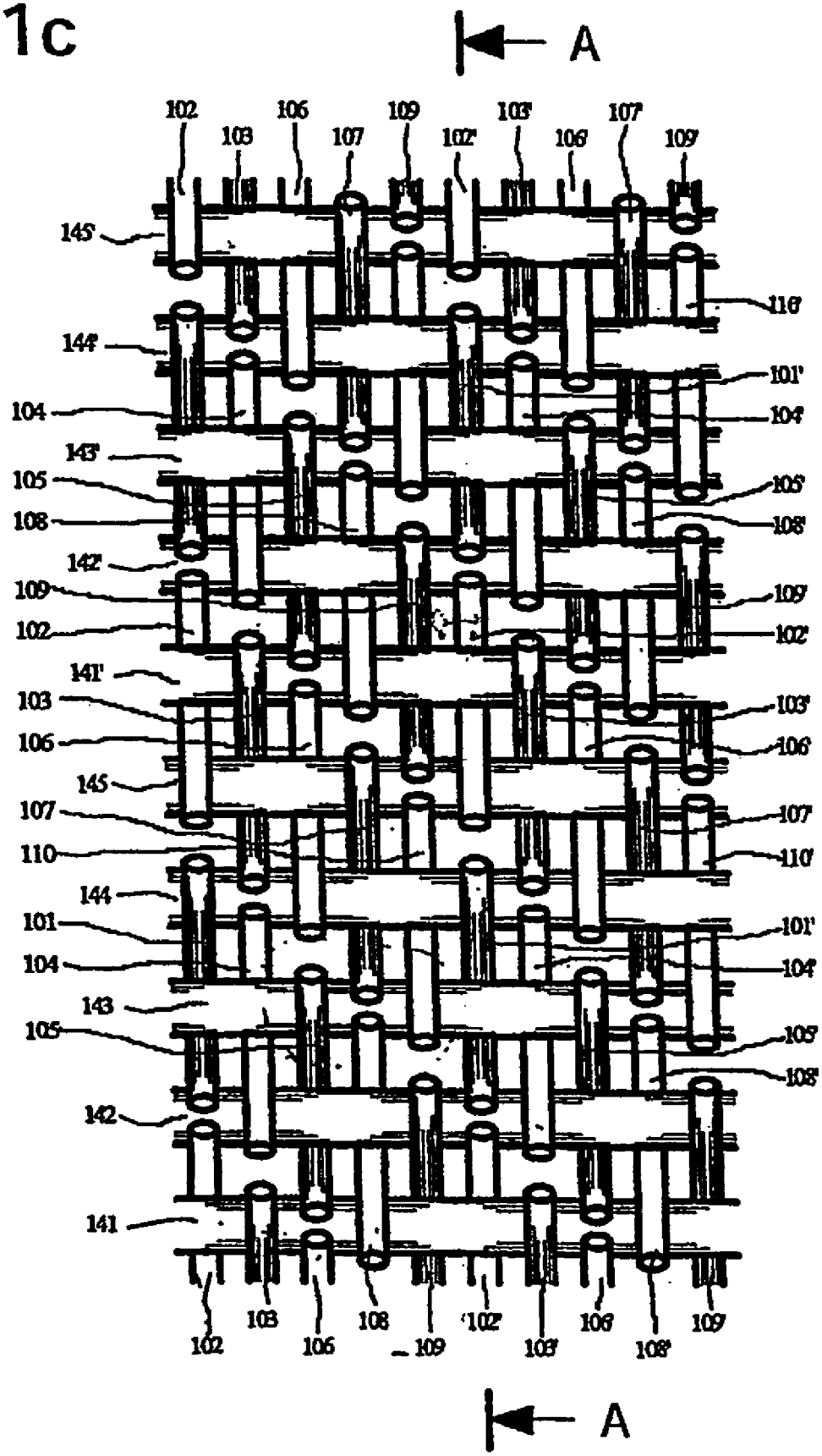
FIG. 1*c* is a top plan view of one extract of the lower or machine side, without the upper cross direction wires as a section between the fabric layers 1T and 1B, of the wire cloth of FIG. 1*a;*

The wire cloth shown in FIGS. 1*a*, 1*b*, 1*c* in the form of the papermaking wire cloth implements the fabric, according to a first exemplary embodiment of the present invention, with a ratio of cross direction wires from the top (121 to 130) to the bottom (141 to 145) of 2:1. The joining of the two fabric layers 1T and 1B is by the replacement of two directly adjacent making direction wires 101 to 110 used as a functional pair. In this connection the following making direction wires can be regarded as pairs, specifically 101, 102; 103, 104; 105, 106; 107, 108, and 109 and 110. The reference numbers having an apostrophe, that is, for example 101' instead of 101, this means that the following repeat is being addressed.

Figure 2A:
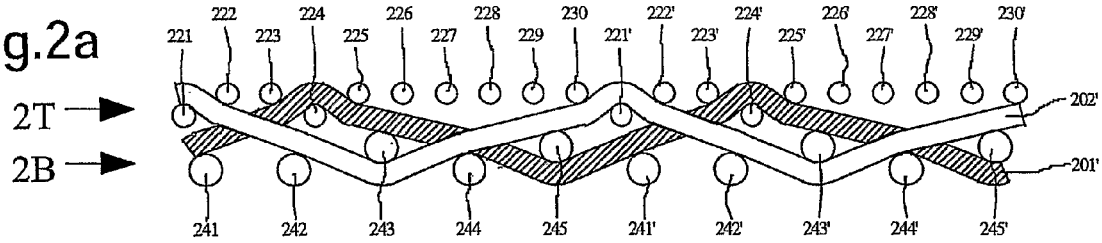
FIG. 2*a* is a side elevational view in section taken along line B-B of FIG. 2*b* and FIG. 2*c* of a papermaking wire cloth, according to a second exemplary embodiment of the present invention, illustrating the extension of the making direction wires and the layers being joined by replacement of the making direction wires.
Figure 2B:
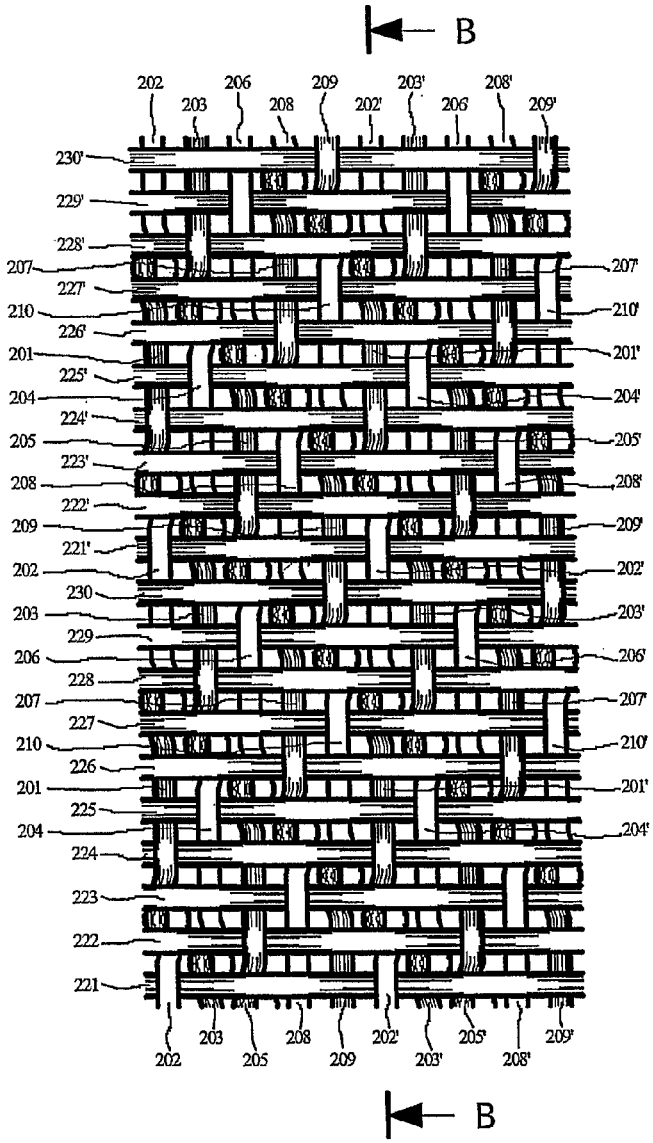
FIG. 2*b* is a top plan view of one extract of the top or paper side of the wire cloth of FIG. 2*a;*
Figure 2C:
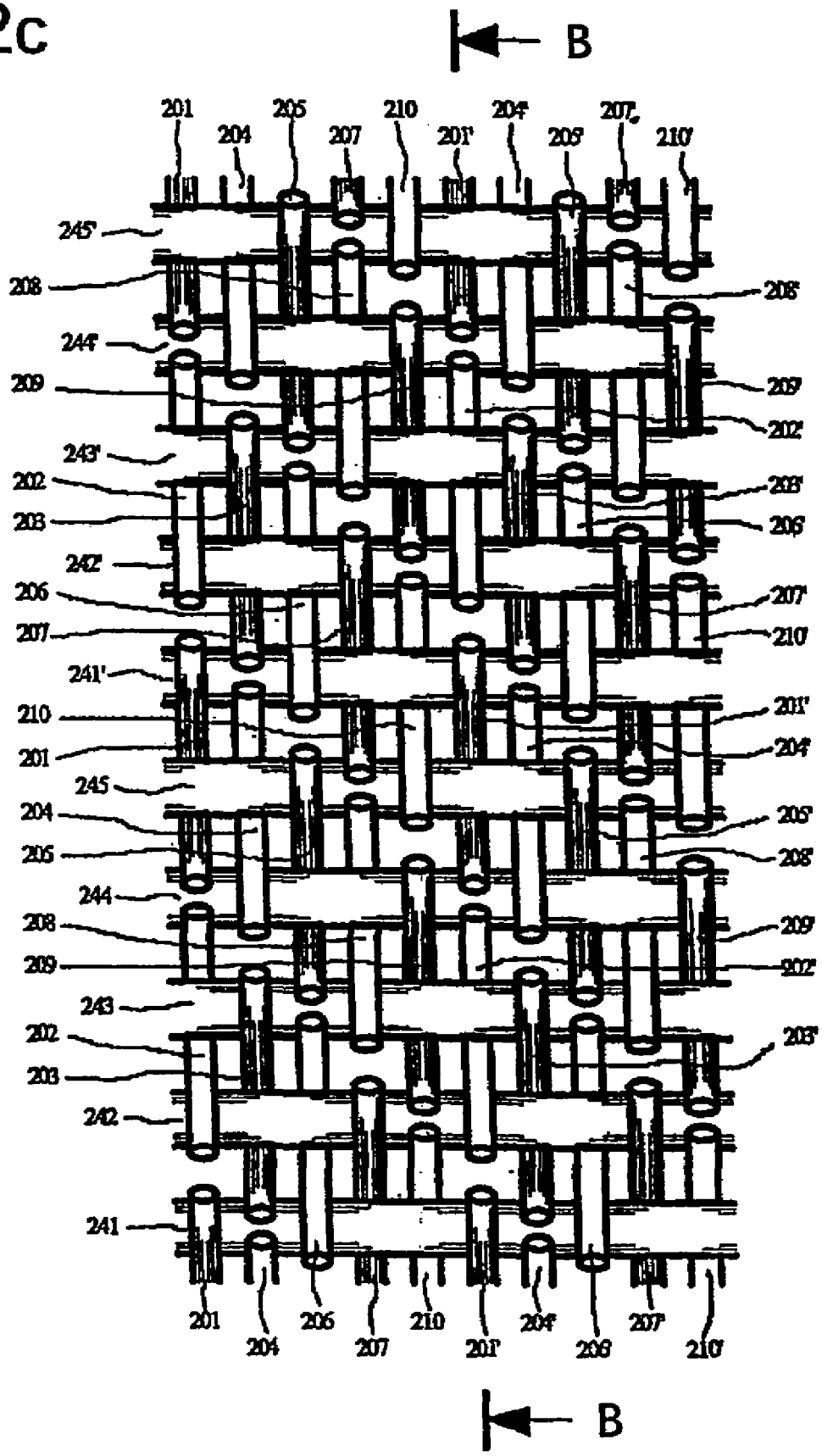
FIG. 2*c* is a top plan view of one extract of the lower or machine side, without the upper cross direction wires as a section between the fabric layers 2T and 2B, of the wire cloth of FIG. 2*a;*

The second exemplary embodiment of the present invention shown in FIGS. 2*a* to 2*c* relates to a papermaking wire cloth described comparably to the first embodiment, by the altered configuration of the tying sites of the making direction wires 201 to 210 on the top. A modified nature of the paper side has been achieved, such that there are only few markings in the paper. In this exemplary embodiment, the ratio of the cross direction wires from the top side 121 to 130 to the bottom side 141 to 145 is 2:1. The connection of the fabric layers 2T and 2B takes place by replacement of two directly adjacent making direction wires 201 to 210 used as a functional pair. In this connection, the following making direction wires can be regarded as pairs 201, 202; 203, 204; 205, 206; 207, 208, and 209 and 210.

Figure 3A:
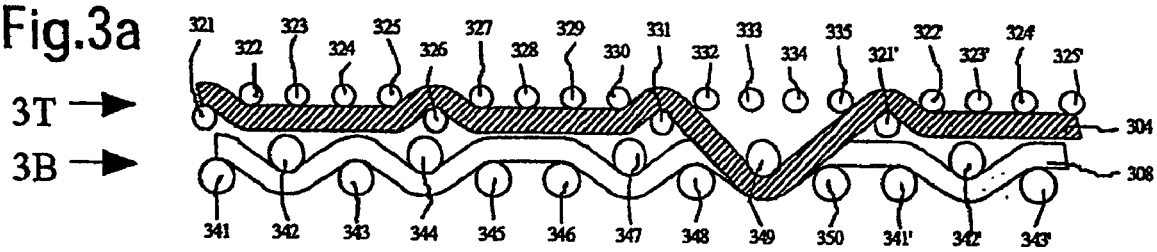
FIG. 3*a* is a side elevational view in section taken along line C-C of FIGS. 3*b* and 3*c* of a papermaking wire cloth, according to a third exemplary embodiment of the present invention illustrating the extension of the making direction wires and the layers being joined by replacement of the making direction wires.
Figure 3B:
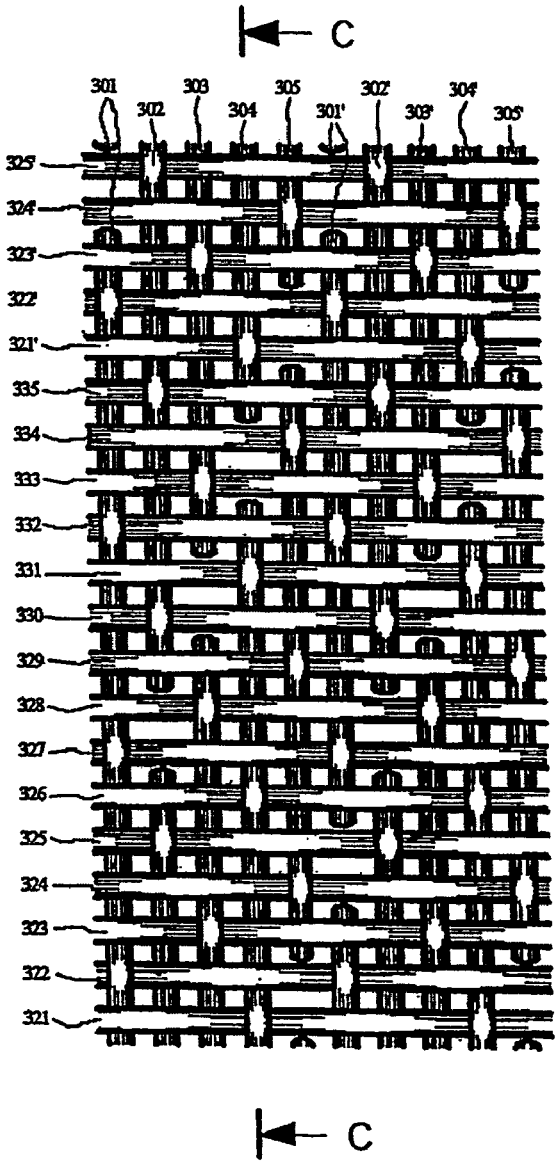
FIG. 3*b* is a top plan view of one extract of the top or paper side of the wire cloth of FIG. 3*a;*
Figure 3C:
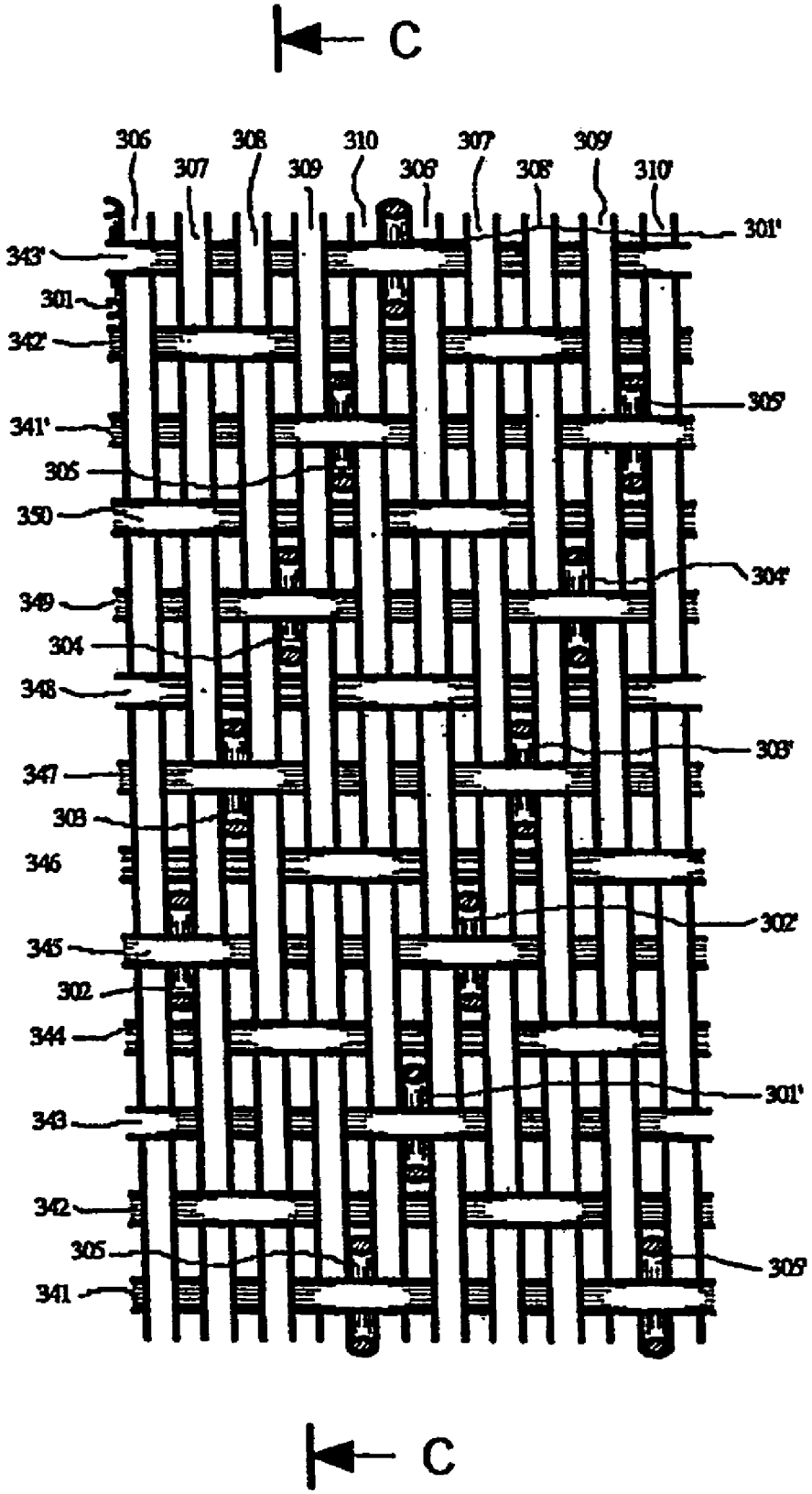
FIG. 3*c* is a top plan view of one extract of the lower or machine side, without the upper cross direction wires as a section between the fabric layers 3T and 3B, of the wire cloth of FIG. 3*a;*

In the third exemplary embodiment of the present invention shown in FIGS. 3*a*, 3*b*, 3*c*, the fabric has a ratio of cross direction wires from the top side 321 to 335 to the bottom side 341 to 350 of 3:2. The joining of the two fabric layers 3T and 3B is implemented by the tying of the upper making direction wires 301 to 305 to the lower cross direction wires 341 to 350. Here, the binding site is chosen such that it lies exactly between the binding sites of the lower making direction wires 306 to 310, and thus, is protected against wear from the bottom.

Figure 4A:
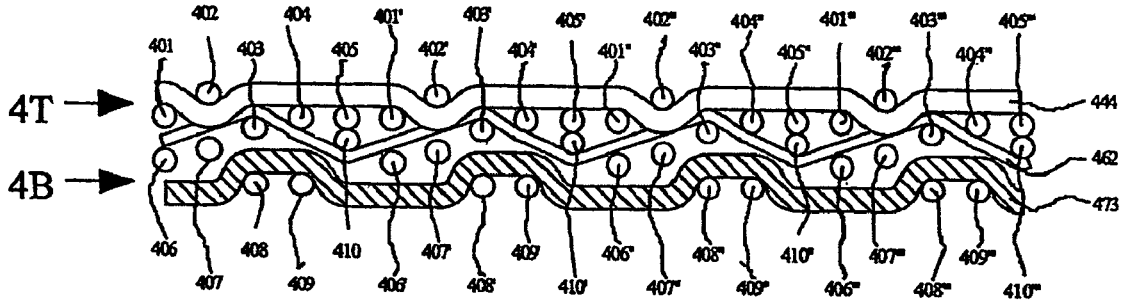
FIG. 4*a* is a side elevational view in section taken along line D-D of FIG. 4*b* and FIG. 4*c* of a papermaking wire cloth, according to a fourth exemplary embodiment of the present invention illustrating the extension of the cross direction wires and the layers being joined by replacement of the making direction wires.
Figure 4B:
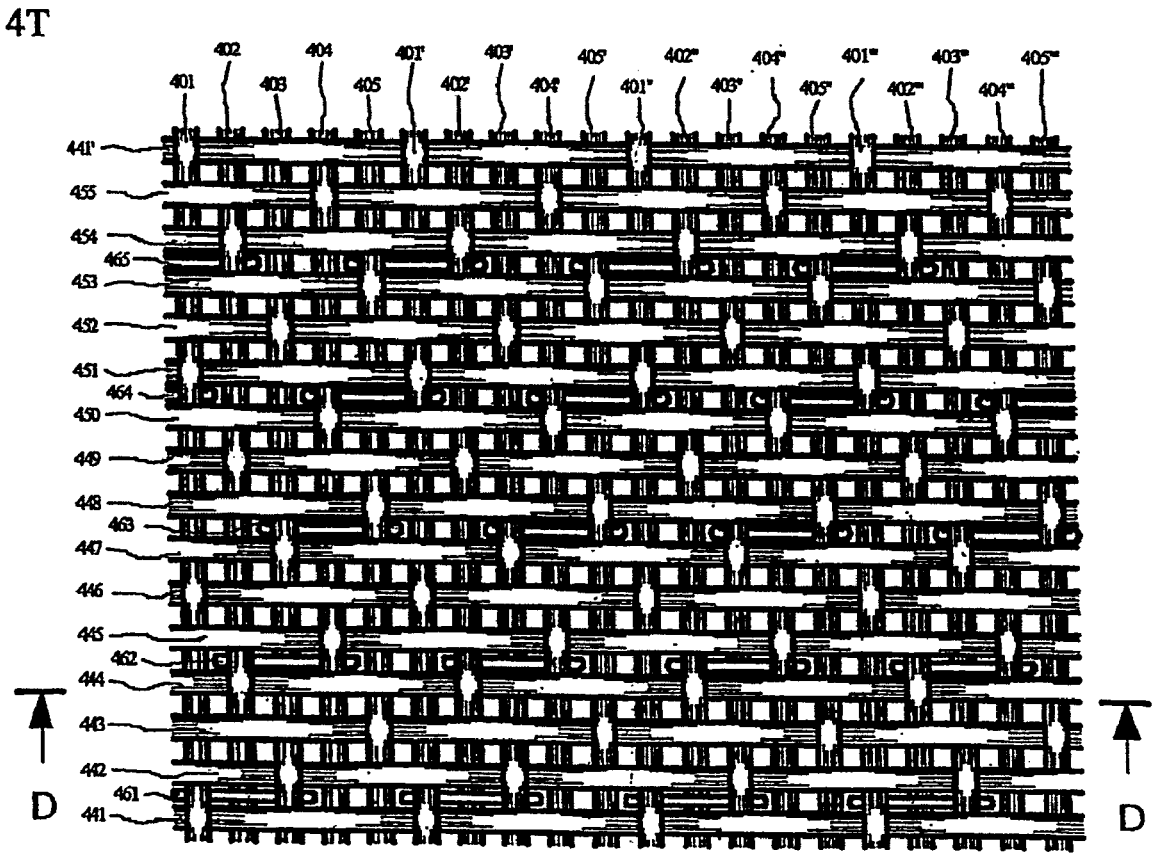
FIG. 4*b* is a top plan view of one extract of the top or paper side of the wire cloth of FIG. 4*a*.
Figure 4C:
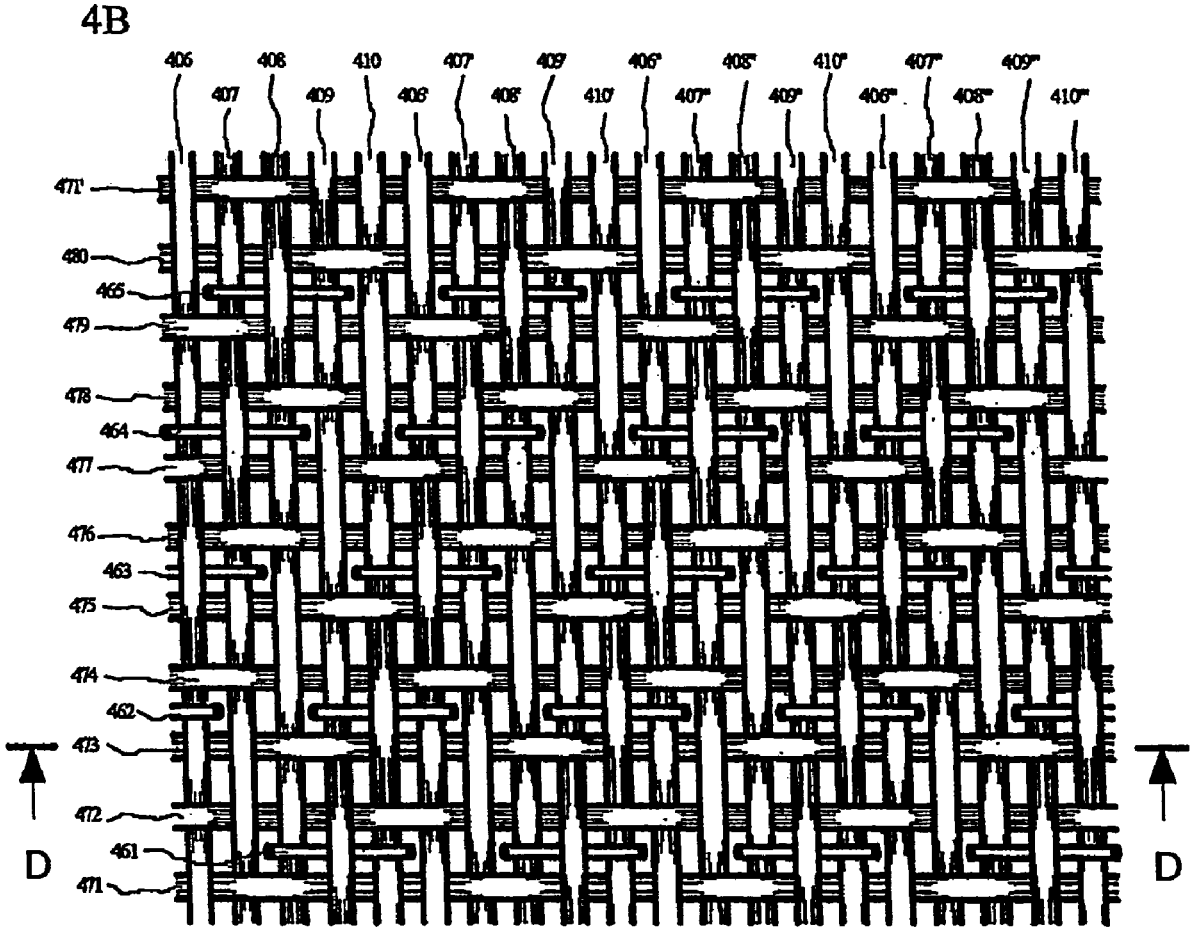
FIG. 4*c* is a top plan view of one extract of the lower or machine side, without the upper cross direction wires as a section between the fabric layers 4T and 4B, of the wire cloth of FIG. 4*a*.

The fourth exemplary embodiment of the present invention shown in FIGS. 4*a*, 4*b*, 4*c* shows a fabric with a ratio of cross direction wires from the top side 441 to 455 to the bottom side 471 to 480 of 3:2. The joining of the two fabric layers 4T and 4B is by separate binding wires 461 to 465 made as a cross direction wire.

The diameter of the upper making direction wires can be equal to the diameter of the lower making direction wires. The diameter of the upper making direction wires can also be less than or equal to the diameter of the lower making direction wires. Furthermore, the diameter of the upper cross direction wires can be smaller than that of the lower cross direction wires. If making direction wires are addressed in the text of the application, they represent the warp threads of the fabric. The cross making direction wires are the weft threads. If the flexural stiffness of the wire cloth in the transverse direction is addressed, the transverse direction for the wire cloths runs perpendicular to the latter, for example vertically along line A-A in FIG. 1*b*. The direction the machine runs can then be viewed as parallel to line A-A in FIG. 1*b*. For preparing the fabric, it is fundamentally possible to interchange the making direction wires and the cross direction wires if a special weave form should make this necessary While various embodiments have been chosen to illustrate the invention, it will be understood by those skilled in the art that various changes and modifications can be made therein without departing from the scope of the invention as defined in the appended claims.

What is claimed is:

1. A papermaking wire cloth, comprising:

an upper fabric layer of upper making direction wires and upper cross direction wires;

a lower fabric layer of lower making direction wires and lower cross direction wires, the number of upper making direction wires is identical to the number of lower making direction wires, the number of upper cross direction wires is greater than the number of lower cross direction wires; and wire bridges connecting said fabric layers without binding to other wires over a definable path extension within a pattern repeat, said wire bridges of said upper cross direction wires extending within a pattern repeat at least over nine of said making direction wires and at most under one of said making direction wires, said wire bridges of said lower cross direction wires within a pattern repeat extending under at least six of said making direction wires and over at least two of said making direction wires, at least one other of the making direction wires extending under a same one of said cross direction wires between two of said making direction wires extending over one of said cross direction wires.

2. A papermaking wire cloth according to claim 1 wherein said upper and lower fabric layers are joined by one of said making direction wires and additional cross direction wires as binding wires.

3. A papermaking wire cloth according to claim 1 wherein said upper and lower fabric layers are joined by replacement of two of said making direction wires within a fabric of said upper and lower fabric layers.

4. A papermaking wire cloth according to claim 1 wherein said upper and lower fabric layers are joined by binding one of said upper making direction wires to one of said lower cross direction wires forming a tying site thereof located between tying sites of two of said lower making direction wires on the same one of the lower cross direction wires.

5. A papermaking wire cloth according to claim 1 wherein said upper and lower fabric layers are joined to form a fabric by a cross direction wire additionally placed in said fabric and joining one of said lower making direction wires within a pattern repeat of said fabric.

6. A papermaking wire cloth according to claim 1 wherein a ratio of the number of said upper cross direction wires to the number of said lower cross direction wires is 2:1.

7. A papermaking wire cloth according to claim 1 wherein a ratio of the number of said upper cross direction wires to the number of said lower cross direction wires is 3:2.

8. A papermaking wire cloth, comprising:

an upper fabric layer of upper making direction wires and upper cross direction wires;

a lower fabric layer of lower making direction wires and lower cross direction wires;

wire bridges connecting said fabric layers without binding to other wires over a definable path extension within a pattern repeat, said wire bridges of said upper cross direction wires extending within a pattern repeat at least over nine of said making direction wires and at most under one of said making direction wires, said wire bridges of said lower cross direction wires within a pattern repeat extending under at least six of said making direction wires and over at least two of said making direction wires, at least one other of the making direction wires extending under a same one of said cross direction wires between two of said making direction wires extending over one of said cross direction wires; and said upper and lower fabric layers being joined by binding one of said upper making direction wires to one of said lower cross direction wires forming a tying site thereof located between tying sites of two of said lower making direction wires on the same one of the lower cross direction wires.

9. A papermaking wire cloth according to claim 8 wherein a ratio of the number of said upper cross direction wires to the number of said lower cross direction wires is 2:1.

10. A papermaking wire cloth according to claim 8 wherein a ratio of the number of said upper cross direction wires to the number of said lower cross direction wires is 3:2.

11. A papermaking wire cloth, comprising:

an upper fabric layer of upper making direction wires and upper cross direction wires;

a lower fabric layer of lower making direction wires and lower cross direction wires;

wire bridges connecting said fabric layers without binding to other wires over a definable path extension within a pattern repeat, said wire bridges of said upper cross direction wires extending within a pattern repeat at least over nine of said making direction wires and at most under one of said making direction wires, said wire bridges of said lower cross direction wires within a pattern repeat extending under at least six of said making direction wires and over at least two of said making direction wires, at least one other of the making direction wires extending under a same one of said cross direction wires between two of said making direction wires extending over one of said cross direction wires; and said upper and lower fabrics being joined to form a fabric by a cross direction wire additionally placed in said fabric and joining said lower making direction wires within a pattern repeat of said fabric.

12. A papermaking wire cloth according to claim 11 wherein a ratio of the number of said upper cross direction wires to the number of said lower cross direction wires is 2:1.

13. A papermaking wire cloth according to claim 11 wherein a ratio of the number of said upper cross direction wires to the number of said lower cross direction wires is 3:2.

* * * * *